US005732718A

United States Patent [19]

Douglas et al.

[11] Patent Number: 5,732,718

[45] Date of Patent: Mar. 31, 1998

[54] SELECTIVE FILTRATION DEVICE

[75] Inventors: Annmarie Veronica Douglas, Norcross; Robert Gillette Geer, Canton; Benji Dawn Morgan, Atlanta, all of Ga.

[73] Assignee: Schweitzer-Mauduit International, Inc., Alpharetta, Ga.

[21] Appl. No.: 294,701

[22] Filed: Aug. 23, 1994

[51] Int. Cl.[6] ..... A24B 15/00; A24B 15/42; A24D 3/04; A24D 3/06

[52] U.S. Cl. ..... 131/342; 131/331

[58] Field of Search ..... 131/342, 331

[56] References Cited

U.S. PATENT DOCUMENTS

| | | | |
|---|---|---|---|
| 2,164,702 | 7/1939 | Davidson | 93/1 |
| 2,792,841 | 5/1957 | Larson | 131/208 |
| 2,801,638 | 8/1957 | Schur et al. | 131/208 |
| 2,900,989 | 8/1959 | Davidson | 131/208 |
| 2,954,036 | 9/1960 | Schur et al. | 131/208 |
| 3,079,929 | 3/1963 | Mueller | 131/208 |
| 3,161,557 | 12/1964 | Muller | 156/462 |
| 3,180,911 | 4/1965 | Muller | 264/119 |
| 3,347,247 | 10/1967 | Lloyd | 131/266 |
| 3,413,982 | 12/1968 | Sublett et al. | 131/266 |
| 3,518,921 | 7/1970 | Muller | 93/1 |
| 3,658,069 | 4/1972 | Wise et al. | 131/10.7 |
| 3,804,695 | 4/1974 | Randall et al. | 156/441 |
| 3,805,801 | 4/1974 | Berger et al. | 131/10.5 |
| 3,966,912 | 6/1976 | Fair et al. | 264/118 |
| 4,219,031 | 8/1980 | Rainer et al. | 131/10.5 |
| 4,274,428 | 6/1981 | Muller et al. | 131/331 |
| 4,316,475 | 2/1982 | Suzuki et al. | 131/340 |
| 4,411,641 | 10/1983 | Suzuki et al. | 493/46 |
| 4,488,563 | 12/1984 | Morifuji et al. | 131/336 |
| 4,516,589 | 5/1985 | Rainer et al. | 131/331 |
| 4,583,560 | 4/1986 | Sakai et al. | 131/336 |
| 4,807,647 | 2/1989 | Hayes | 131/336 |
| 5,360,023 | 11/1994 | Blakley et al. | 131/331 |

FOREIGN PATENT DOCUMENTS

| | | |
|---|---|---|
| 0342538 | 11/1989 | European Pat. Off. . |
| 0532329 | 3/1993 | European Pat. Off. . |
| 908663 | 10/1962 | United Kingdom . |

OTHER PUBLICATIONS

Prior Sale of Carbon–Containing Paper Sheets.

The Taryton® Cigarette Filter.

Database WPI, Week 8547, Derwent Publications Ltd., London, GB; AN 85–293580 & JP,A,60 202 734 (Toyobo), 14 Oct. 1985, See Abstract.

Patent Abstracts of Japan, vol. 003 No. 003 (C–033), 16 Jan. 1979 & JP,A,53 127899 (Japan Tobacco Inc.) 08 Nov. 1978, See Abstract.

PCT Search Report.

*Primary Examiner*—Kimberly L. Asher

*Attorney, Agent, or Firm*—Dority & Manning, P.A.

[57] ABSTRACT

Disclosed is a filter for tobacco smoke composed of at least one layer of a wet-formed absorbent fibrous nonwoven composite structure containing: 1) from about 30 to about 65 percent, by weight, of pulp fibers forming a matrix having a first exterior surface and a second exterior surface; and 2) about 35 to about 70 percent, by weight, of activated carbon integrated into the matrix of pulp fibers such that the concentration of activated carbon adjacent the first exterior surface is at least about 60 percent, as determined by optical image analysis, and the concentration of activated carbon adjacent the second exterior surface is less than about 40 percent, as determined by optical image analysis, so that the filter is adapted to selectively reduce the $C_3$–$C_4$ carbonyl component of conventional tobacco smoke at least about 25 percent more than a conventional cellulose acetate filter for an identical tobacco smoke. Also disclosed is a method of making the filter.

21 Claims, 4 Drawing Sheets

SELECTIVE FILTRATION DEVICE

FIELD OF THE INVENTION

The present invention relates to cigarette filters used in smoking articles. More particularly, the present invention relates to filters which include activated carbon.

BACKGROUND

Filtered cigarettes are well-known and are a common form of smoking article. Filtered cigarettes comprise a column of tobacco and, at one end, a filter plug (i.e., a filter). The column of tobacco is wrapped in cigarette paper and the filter plug is joined to the cigarette by tipping paper. Although there are some exceptions, conventional filters are typically formed either from compressed strips of paper or cellulose acetate tows. Some filters include activated carbon.

Activated carbon is readily obtained in granular or particulate form. Incorporating activated carbon granules or particles into a filter may pose difficulties, especially when it is desired to provide the maximum amount of adsorption activity. For example, loose activated carbon granules may be captured between two segments of filter tow. However, such a configuration may use large amounts of carbon, which adds expenses. Such filters can be difficult to produce, especially in high-speed manufacturing processes. Activated carbon granules or particles can be joined to a tow by adhesive or thermal bonding. However, it may be difficult to get high loadings of carbon associated with desirable levels of adsorption activity. Some effective techniques for bonding carbon add expense to the filter and complexity to the manufacturing processes. Also, the bonding techniques may impart undesirable taste or change the performance of the filter. Activated carbon particles can be incorporated into paper sheet. However, a large number of activated carbon particles get buried in the interior of the sheet. During use, a substantial portion of the gas stream passes over the surface of the sheet and is inaccessible to the buried carbon particles. One deficiency with paper/activated carbon sheets is that buried activated carbon particles offer relatively little surface area readily accessible to a gas stream passing over the sheet.

Loading up a greater proportion of activated carbon particles in the sheet decreases the sheet integrity and handling characteristics, decreases the relative adsorption activity of the activated carbon in the highly loaded sheet, increases cost and shedding or linting, and may create problems during manufacture.

Accordingly, there is a need in the industry for a filter for smoking articles made from an adsorbent fibrous nonwoven composite structure containing activated carbon particles which is inexpensive but has good adsorption activity (e.g., gas adsorption activity), integrity and handling characteristics.

DEFINITIONS

As used herein, the term "fibrous nonwoven structure" refers to a structure of individual fibers or filaments which are interlaid, but not in an identifiable repeating manner. Nonwoven structures such as, for example, fibrous nonwoven webs have been, in the past, formed by a variety of processes known to those skilled in the art including, for example, wet-formation papermaking processes, air-forming process, and carding processes.

As used herein, the term "adsorbent fibrous nonwoven composite structure" refers to a matrix of pulp fibers and at least one type of an activated carbon integrated into the matrix of pulp fibers. The activated carbon may be in particulate form or fibrous form.

As used herein, the term "pulp" refers to cellulosic fibers from natural sources such as woody and non-woody plants. Woody plants include, for example, deciduous and coniferous trees. Non-woody plants include, for example, cotton, flax, esparto grass, milkweed, straw, jute, hemp, tobacco and bagasse.

As used herein, the term "activated carbon" refers to a generally amorphous form of carbon characterized by high adsorbtivity for many gases, vapors and colloidal solids. The activity of this form of carbon is a measure of surface area available for adsorption and is expressed in units of area per unit weight of carbon (e.g., square meters per gram). Activated carbon may be in particulate form or relatively fibrous form.

As used herein, the term "$C_3$–$C_4$ carbonyl component" refers to organic compounds found in tobacco smoke which contain 3 to 4 carbon atoms in which an oxygen atom is fully bonded to a single carbon atom. Exemplary compounds include, but are not limited to, acetone, 2-propenal (a.k.a. acrolein), propionaldehyde (a.k.a. propanol), 2-butenal (a.k.a. crotonaldehyde), 2-butanone (a.k.a. methyl ethyl ketone) and n-butryaldehyde.

As used herein, the term "selectively reduce" or "selective reduction" refers to a decrease produced by a filter in the amount of one or more specified components of tobacco smoke which is disproportionately greater than the decrease of other specified components of the same tobacco smoke. For example, certain components of tobacco smoke from a conventional tobacco rod may be decreased by a filter attached to an end of the tobacco rod in an amount which is disproportionately greater than the reduction in delivered particulates (e.g., as expressed by a reduction in delivered tar and/or nicotine) when the tobacco smoke stream is passed through the filter (e.g., over the filter surfaces) during normal use.

As used herein, the term "conventional cellulose acetate filter" refers to a conventionally formed filter made of cellulose acetate tow treated with triacetin plasticizer. The tow filaments may have various cross-sections, about 2.5 to 3 denier per filament and a total denier of about 30,000 to 40,000. Desirably, the tow filaments may have a "Y" cross-section, about 2.7 denier per filament and a total denier of about 35,000.

The term "machine direction" as used herein refers to the direction of travel of the forming surface onto which fibers are deposited during formation of an nonwoven web.

The term "cross-machine direction" as used herein refers to the direction which is perpendicular to the machine direction defined above.

The term "wet-end suspension additive" as used herein refers to a material added to an aqueous suspension of fibers (or fibers and particulates) at the wet-end of a papermaking process. The purpose of the suspension additive is to enhance uniformity or homogeneity of the fiber (or fiber/particulate) distribution in a wet-formed fibrous sheet and to promote bonding of fibers (or fibers and particulates) in the sheet. Some types of cationic surfactants may be used as wet-end suspension additives.

The term "wet-end retention additive" as used herein refers to a material added to an aqueous suspension of fibers (or fibers and particulates) at the wet-end of a papermaking process. The purpose of the retention additive is to increase the amount of fibers and/or particulates caught by the forming fabric when the aqueous suspension is deposited on the forming fabric during the papermaking process. Generally speaking, wet-end retention additives do not enhance uniformity or homogeneity of the fiber (or fiber/particulate) distribution in a wet-formed fibrous sheet. One useful wet-end retention additive is polyacrylamide.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The present invention responds to the needs described above by providing a filter for tobacco smoke composed of at least one layer of a wet-formed absorbent fibrous nonwoven composite structure containing: 1) from about 30 to about 65 percent, by weight, of pulp fibers forming a matrix having a first exterior surface and a second exterior surface; and 2) from about 35 to about 70 percent, by weight, of activated carbon integrated into the matrix of pulp fibers such that the concentration of activated carbon adjacent the first exterior surface is at least about 60 percent, as determined by optical image analysis, and the concentration of activated carbon is less than about 40 percent, as determined by optical image analysis. According to the invention, this structure provides a filter which is adapted to selectively reduce the $C_3$–$C_4$ carbonyl component of conventional tobacco smoke at least about 25 percent more than a conventional cellulose acetate filter for an identical tobacco smoke. For example, the filter may be adapted to selectively reduce the $C_3$–$C_4$ carbonyl component of conventional tobacco smoke from about 30 to about 50 percent more than a conventional cellulose acetate filter for an identical tobacco smoke. It is contemplated that, in some situations, the filter of the present invention may selectively reduce components of tobacco smoke in addition to the desired selective reduction of the $C_3$–$C_4$ carbonyl component.

Desirably, the concentration of activated carbon adjacent the first exterior surface may be at least about 65 to about 85 percent, as determined by optical image analysis, and the concentration of activated carbon may be less than about 35 to about 40 percent, as determined by optical image analysis.

In one aspect of the present invention, the wet-formed absorbent fibrous nonwoven composite structure of the filter contains about 45 to about 55 percent, by weight, of pulp fibers and about 55 to about 45 percent, by weight, of activated carbon.

The filter may include channels having a depth of from about 0.12 inch to about 0.4 inch at a density of from about 10 to about 20 channels per inch of width across a planar dimension of the absorbent fibrous nonwoven composite structure. For example, the channels may have a depth of from about 0.15 inch to about 0.25 inch and a density of from about 12 to about 16 channels per inch across a planar dimension of the filter. As a further example, the channels may have a depth of from about 0.18 inch to about 0.22 inch and a density of from about 13 to about 15 channels per inch across a planar dimension of the filter. Desirably, the grooves run along a planar dimension generally parallel to the path tobacco smoke travels during normal use of the filter.

Generally speaking, the pulp fibers of the wet-formed adsorbent fibrous nonwoven composite structure are hardwood or softwood pulp fibers. The pulp fibers may also come from non-woody plants. Non-woody plants include, for example, cotton, flax, esparto grass, milkweed, straw, jute, hemp, tobacco and bagasse.

The adsorbent fibrous nonwoven composite structure of the filter may have a basis weight from about 20 gsm to about 100 gsm. For example, the adsorbent fibrous nonwoven composite structure of the filter may have a basis weight from about 50 gsm to about 55 gsm.

Generally speaking, the activated carbon in the matrix of pulp fibers is finely pulverized activated carbon. Desirably, the activated carbon will have an average particle size such that it can pass through a screen of 350 mesh or less (e.g., an average particle size of less than about 350 mesh).

According to the present invention, the filter for tobacco smoke may contain at least two layers of the adsorbent fibrous nonwoven composite structure.

The present invention encompasses a method of making a filter for tobacco smoke composed of at least one layer of a wet-formed absorbent fibrous nonwoven composite structure. The process includes the following steps: 1) providing an aqueous suspension containing about 30 to about 65 percent pulp fibers and from about 35 to about 70 percent activated carbon based on the weight of the suspended material, the activated carbon having an average particle size of less than about 350 mesh; 2) depositing the aqueous suspension onto a paper-making forming surface to form a matrix of pulp fibers having a first exterior surface and a second exterior surface with adsorbent material integrated into the matrix of pulp fibers; 3) removing water from the matrix of pulp fibers under sufficient vacuum so that activated carbon is concentrated near one surface of the matrix to yield an adsorbent fibrous nonwoven composite structure; 4) substantially drying the adsorbent fibrous nonwoven composite structure; and 5) gathering the adsorbent fibrous nonwoven composite structure into the shape of a radially elastic filter body; so that the filter is adapted to selectively reduce the $C_3$–$C_4$ carbonyl component of conventional tobacco smoke at least about 25 percent more than a conventional cellulose acetate filter for an identical tobacco smoke.

Generally speaking, the aqueous suspension containing pulp fibers and activated carbon should be free of wet-end suspension additives. According to the invention, the removal of water may desirably be conducted under sufficient vacuum so that the adsorbent fibrous nonwoven composite structure has a concentration of adsorbent material adjacent the first exterior surface of the matrix of at least about 60 percent, as determined by optical image analysis, and a concentration of adsorbent material adjacent the second exterior surface of the matrix of less than about 40 percent, as determined by optical image analysis.

The method of the present invention may include the step of creating channels in the adsorbent fibrous composite structure prior gathering the adsorbent fibrous nonwoven composite structure into the shape of a radially elastic filter body. The channels may have a depth of from about 0.12 inch to about 0.4 inch at a density of from about 10 to about 20 channels per inch of width across a planar dimension of the adsorbent fibrous nonwoven composite structure.

The adsorbent fibrous nonwoven composite structure may be dried utilizing a compressive or non-compressive drying process. Steam can or steam roll drying processes have been found to work particularly well. Other drying processes which incorporate infra-red radiation, yankee dryers, through-air dryers, microwaves, and ultrasonic energy may also be used.

According the invention, the generally flat adsorbent fibrous nonwoven composite structure is gathered into the shape of a radially elastic filter body utilizing a conventional filter rod pre-forming apparatus and filter rod maker. The filter rod may be used alone or in combination with conventional fibers (e.g., a conventional cellulose acetate tow filter). Desirably, the filter rod of the present invention is located between the tobacco rod and a conventional cellulose acetate filter.

DETAILED DESCRIPTION OF THE INVENTION

Figure 1:
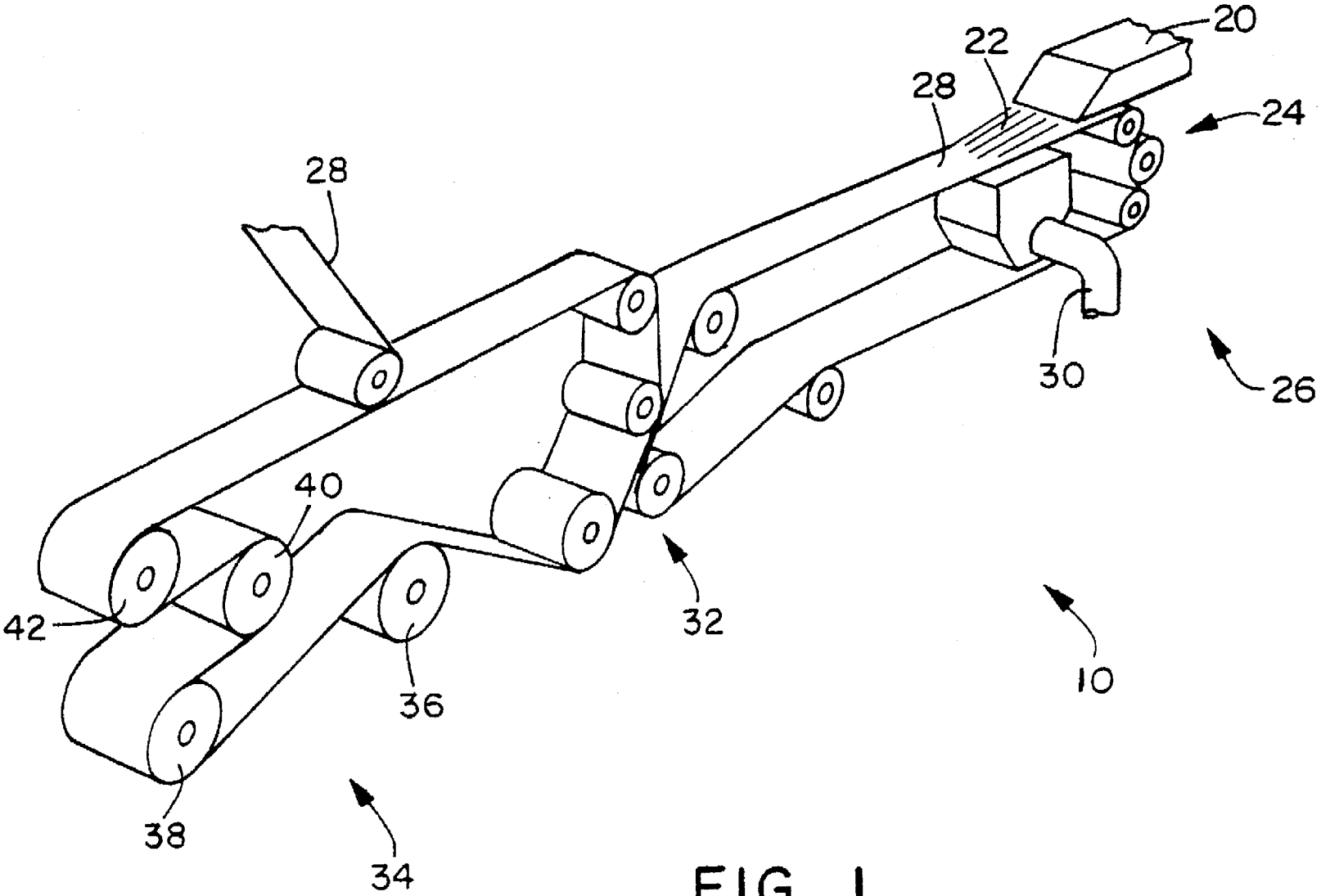
FIG. 1 is an illustration of an apparatus which may be used to form an adsorbent fibrous nonwoven composite structure used in an exemplary filter.

Referring to FIG. 1 of the drawings there is schematically illustrated at 10 a process for forming a wet-formed adsorbent nonwoven composite structure used in the filter for tobacco smoke of the present invention. This composite structure includes pulp fibers and activated carbon distributed throughout the pulp fiber matrix. Desirably, the activated carbon is incorporated in the matrix in a manner such that the activated carbon surface area is available in a generally non-linear gradient distribution.

A wet-formed adsorbent nonwoven composite material is made by forming a dilute suspension of fibers and activated carbon, supplying that suspension to a headbox 20 and depositing it via a slice 22 as a slurry onto a foraminous screen 24 of a conventional papermaking machine 26.

The suspension of fibers may be diluted to any consistency which is typically used in conventional wet-laying processes. For example, the suspension may contain from about 0.02 to about 5 percent by weight fibers and/or activated carbon suspended in water.

Generally speaking, activated carbon is blended in the pulp slurry prior to formation of the sheet. Alternatively and/or additionally, the activated carbon may be deposited in the pulp slurry as it enters the headbox, while in the slice or as it is deposited on the foraminous screen.

The suspension of fibers and activated carbon is deposited on the foraminous surface 24 and water is removed to form a non-uniform nonwoven web of fibers and activated carbon 28. Typically, the foraminous surface 24 is a mesh fabric used in conventional papermaking processes. Water is removed from the deposited layer of fibers and adsorbent material by vacuum dewatering equipment 30 under sufficient vacuum so that an enhanced two-sided or non-homogenous web is formed.

The activated carbon may be in the form of particles or fibers. Generally speaking, the activated carbon in the matrix of pulp fibers is finely pulverized activated carbon. Desirably, the activated carbon will have an average particle size such that it can pass through a screen of 350 mesh or less (e.g., an average particle size of less than about 350 mesh—about 40 microns). Suitable activated carbon particles are available from the Calgon Carbon of Pittsburgh, Pa. under the designation Calgon Carbon Type PCB Granular Activated Carbon.

In one aspect of making the adsorbent fibrous nonwoven composite structure, it is desirable that no wet-end suspension additives are added to the aqueous suspension of pulp fibers and activated carbon material. Wet-end suspension additives are typically formed from an organic material such as, for example, natural gums, as well as synthetic materials such as synthetic hydrogel polymers or hydrophilic colloids (also referred to as "hydrocolloids").

Although the inventors should not be held to a particular theory of operation, it is believed that by removing wet-end suspension additives that promote uniform dispersion of activated carbon in the suspension of pulp and adsorbent, a two-sided or heterogenous distribution of activated carbon is achieved in the resulting sheet. Absence of wet-end suspension additives is believed to increase the tendency of the activated carbon in a slurry processed by a Fourdrinier-type papermaking machine to be concentrated by the effects of gravity, mixing, sheet formation, and/or dewatering.

Activated carbon particles and/or fibers are added to the pulp slurry by a conventional particulate and/or fiber handling system (not shown) to form the aqueous suspension of activated carbon and pulp fibers. Exemplary particulate handling systems are described in, for example, U.S. Pat. No. 4,604,313, the contents of which regarding particulate handling systems is incorporated herein by reference. Useful particulate handling systems include various engraved roll volumetric feeders as well as other commercial systems such as, for example, Christy dry material dispensing machines available from the Christy Machine Company of Fremont, Ohio; and Meltex™ SAP series powder application systems available from the Nordson Corporation. Useful fiber handling systems include staple fiber web air-forming systems as well as commercial systems available from Moller & Jochumsen of Denmark and Danweb Forming International.

Generally speaking, activated carbon may be present at a proportion of up to about 80 grams of adsorbent per 100 grams total weight of the substantially dry composite material (i.e., the total weight of all components constituting the composite material). For example, the activated carbon may be present at a proportion of about 35 to about 70 grams of activated carbon per 100 grams total weight of the substantially dry composite material. Desirably, the activated carbon may be present at a proportion of about 45 to about 55 grams of activated carbon per 100 grams total weight of the substantially dry composite material.

The fibers may be pulp fibers from woody or non-woody plants as well as secondary (i.e., recycled) fiber pulp. Exemplary wood pulps include bleached and unbleached kraft virgin softwood fiber pulps and bleached and unbleached kraft virgin hardwood pulp. Some useful pulps are those available from the Kimberly-Clark Corporation under the trade designations Alberni K, Longlac 19, Longlac 16, Coosa River 55, Coosa River 56, and Coosa River 57. Secondary fiber pulp may be pulp fibers recycled from sources such as, for example, office waste, newsprint, and paperboard scrap. For example, one useful secondary fiber pulp identified as "BJ de-inked secondary fiber pulp" is available from Ponderosa Pulp Products—a division of Ponderosa Fibers of America, Atlanta, Ga.

Pulp fibers may be unrefined or may be beaten to various degrees of refinement. Small amounts of wet-strength resins and/or resin binders may be added to improve strength and abrasion resistance provided they do not change the heterogenous nature of the pulp/activated carbon distribution achieved by eliminating the wet-end suspension additives described above. Useful binders and wet-strength resins include, for example, Kymene® 557 H available from the Hercules Chemical Company, and Parez 631 available from American Cyanamid, Inc. Cross-linking agents and/or hydrating agents may also be added to the pulp mixture. Debonding agents may be added to the pulp mixture to reduce the degree of hydrogen bonding if a very open or loose (e.g., softer) nonwoven pulp fiber web is desired. One exemplary debonding agent is available from the Quaker Chemical Company, Conshohocken, Pa., under the trade designation Quaker 2008.

If the fibers are pulp fibers, the suspension of fibers and activated carbon may also contain synthetic fibers, natural fibers, bicomponent fibers, or other filaments having various deniers and lengths. Various mixtures of pulp fibers and these other types of fibers may be used. For example, the fibrous component of the adsorbent composite material may contain from about 5 to about 50 percent, by weight, staple length fibers and from about 50 to 95 percent, by weight pulp fibers.

The synthetic fibers may be made from rayon, polyester, polyamides and polyolefins such as, for example, one or more of polyethylene, polypropylene, polybutene, ethylene copolymers, propylene copolymers and butene copolymers. Natural fibers may include, for example, cotton, cotton linters, wool, silk, and flax. Typically, these fibers will have a denier in the range of about 0.7 to about 8 and an average length in the range of about 5 mm to about 36 mm. For example, the fibers may have a denier in the range of about 0.9 to about 3 and an average length in the range of about 10 mm to about 24 mm. Desirably, the fibers may have a denier in the range of about 1 to about 2 and an average length in the range of about 12 mm to about 18 mm.

After the water is drained from the wet-formed adsorbent fibrous nonwoven composite material 28, it is transferred to a drying operation. A differential speed pickup roll 32 may be used to transfer the web from the foraminous belt 24 to a drying operation. Alternatively, conventional vacuum-type pickups and transfer fabrics may be used. Desirably, the drying operation is a non-compressive drying operation. For example, the web may be non-compressibly dried utilizing a conventional steam can or steam roll arrangement shown in FIG. 1 at 34. The wet-formed adsorbent fibrous nonwoven composite material 28 passes over drums 36–42 heated to a temperature ranging from about 150°–175° F. (65°–80° C.). Other drying processes which incorporate infra-red radiation, yankee dryers, through-air dryers, microwaves, and ultrasonic energy may also be used. The dried adsorbent fibrous nonwoven composite material 28 can then be removed and wound on a roll, packaged or quickly introduced into other processes.

It may be desirable to use finishing steps and/or post-treatment processes to impart channels or grooves in the composite 28. Other treatments are contemplated such as, for example, mechanically softening treatments. This softening may be accomplished by calendering, perforating, aperturing, perf-embossing, embossing, pattern embossing, differential drawing, creping, and rollers. Softening may also be accomplished by adding debonding agents to the nonwoven fibrous web before or just after web formation. Alternatively and/or additionally, chemical post-treatments may be added to the web such as, for example, adhesives, dyes, surfactants, cross-linking agents, hydrating agents and/or pigments to impart or enhance desirable properties such as, for example, abrasion resistance, toughness, color, reduced linting or improved adsorption.

Figure 2:
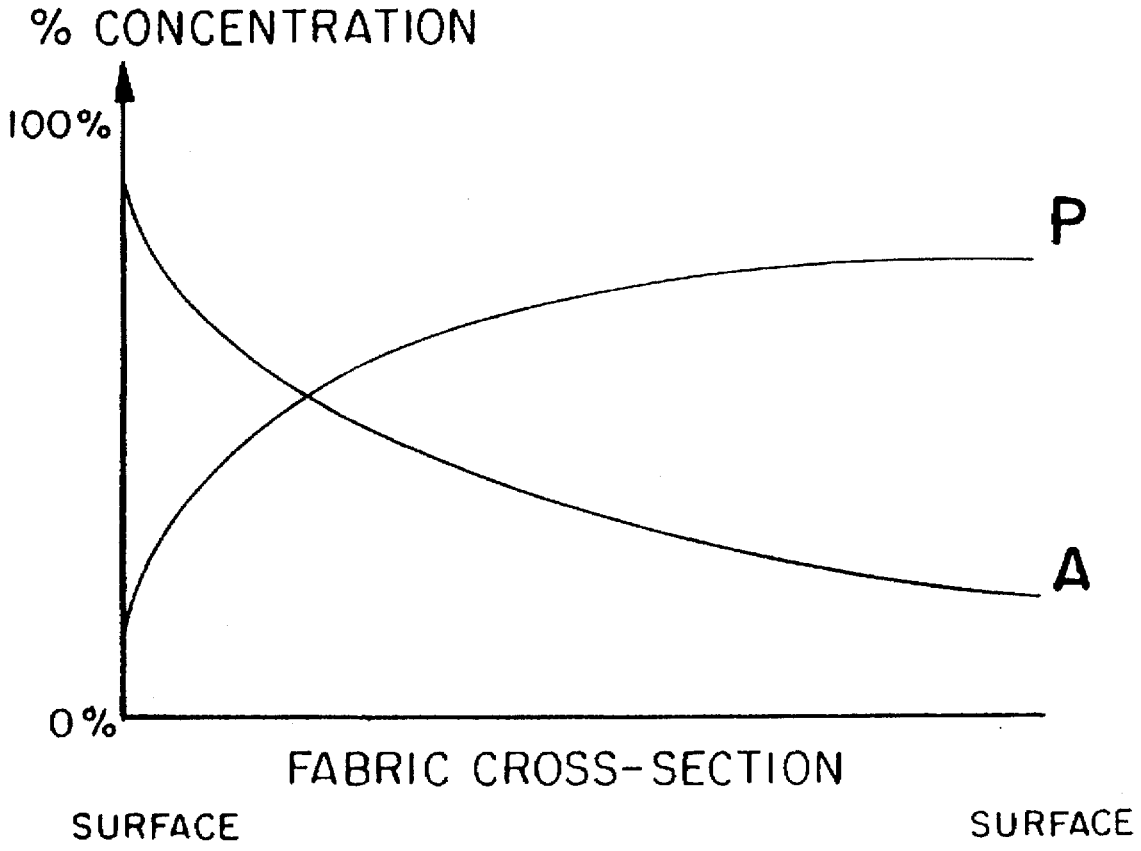
FIG. 2. is a general representation of an exemplary activated carbon/pulp fiber concentration gradient for a cross section of an adsorbent fibrous nonwoven composite structure used in an exemplary filter.

Instead of a generally homogenous distribution of activated carbon throughout the pulp fiber matrix, it is desirable that adsorbent fibrous nonwoven composite structure has an enhanced two-sided, graduated or heterogenous distribution of activated carbon throughout the pulp fiber matrix. More desirably, the gradient distribution of available activated carbon surface area throughout the pulp fiber matrix should be relatively non-linear. That is, the available activated carbon surface area on the activated carbon rich surface of the pulp fiber matrix would be relatively disproportionate to a generally linear gradient distribution of activated carbon particles/fibers across the thickness (i.e., the Z direction) of the pulp fiber matrix. A general representation of an exemplary activated carbon concentration gradient for a cross section such a fibrous nonwoven composite structure is illustrated in FIG. 2. Curve A represents the activated carbon concentration and curve P represents the pulp concentration.

Generally speaking, in the practice of the present invention it is thought that the use of activated carbon material having an average particle diameter of 350 mesh or less and/or suitable relatively fibrous activated carbon materials provides such a non-linear distribution under the appropriate wet-forming conditions. Although the inventors should not be held to a particular theory of operation, it is believed that the absence of wet-end additives in the pulp/activated carbon aqueous suspension can have the effect that, during deposition of the suspension and subsequent vacuum dewatering (with sufficient levels of vacuum), an enhanced two-sided or non-uniform (i.e., graduated, heterogenous) distribution of the fibrous component and activated carbon can be accomplished.

According to one aspect of the present invention, the adsorbent fibrous nonwoven structure is adapted to adsorb an amount of carbon tetrachloride ($CCl_4$) vapor sufficient to increase the basis weight of the nonwoven structure by at least about one and one-half grams per square meter (i.e., 1.5 gsm). For example, the adsorbent fibrous nonwoven structure can be adapted to adsorb an amount of carbon tetrachloride ($CCl_4$) vapor sufficient to increase the basis weight of the nonwoven structure by about 10 to about 20 grams per square meter (i.e., 10–20 gsm). Desirably, the adsorbent fibrous nonwoven structure is adapted to adsorb an amount of carbon tetrachloride ($CCl_4$) vapor sufficient to increase the basis weight of the nonwoven structure by 25 grams per square meter or more (i.e., 25 gsm or more).

Figure 3:
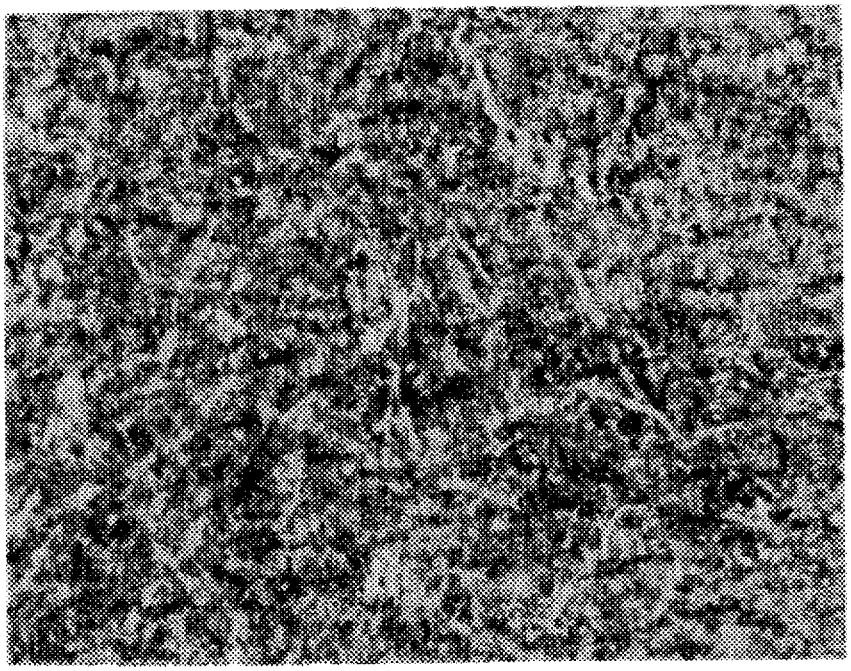
FIG. 3 is a photomicrograph of an activated carbon rich surface of an exemplary adsorbent fibrous nonwoven composite structure.
Figure 4:
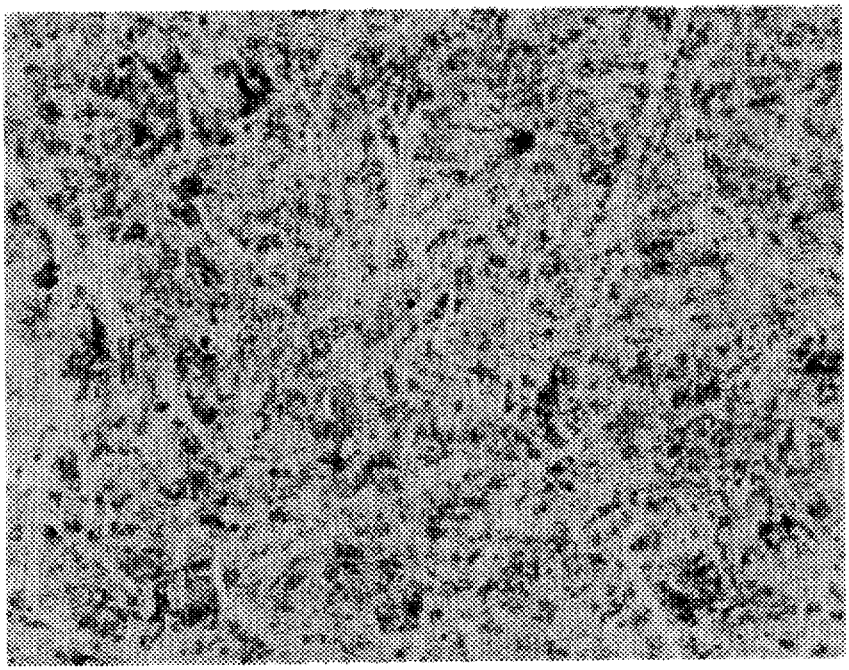
FIG. 4 is a photomicrograph of a pulp rich surface of an exemplary adsorbent fibrous nonwoven composite structure.

Referring now to FIGS. 3–4, these figures are microphotographs of various wet-formed adsorbent fibrous nonwoven composite structures containing about 50 percent, by weight, activated carbon (Calgon Carbon Type PCB Granular Activated Carbon available from Calgon Carbon of Pittsburgh, Pa.) and about 50 percent, by weight, wood pulp (Alberni K softwood pulp available from Kimberly Clark Corporation). More particularly, FIG. 3 is a 43× (linear magnification) photomicrograph of an activated carbon rich side of an exemplary wet-formed adsorbent fibrous nonwoven composite structure. FIG. 4 is a 43× (linear magnification) photomicrograph of the opposite side (i.e., the pulp rich side) of the same exemplary wet-formed adsorbent fibrous nonwoven composite structure. FIGS. 3 and 4 were produced at identical exposures. The exposure was set on the activated carbon rich side of the adsorbent fibrous nonwoven composite structure. As can be seen from FIGS. 3 and 4, the concentration of activated carbon is greater on one surface (i.e., the activated carbon rich surface) of the structure than on the opposite surface (i.e., the pulp rich surface). Activated carbon is also distributed throughout the pulp rich surface (as well as the inner portion of the structure) but at lower concentrations which appear to represent an relatively non-linear distribution of available activated carbon surface area through the pulp fiber matrix. Thus, it can be seen that the structure of FIGS. 3 and 4 can be described as a matrix of pulp fibers having a first exterior surface and a second exterior surface in which activated carbon has been integrated into the pulp fiber matrix so that the concentration of activated carbon adjacent the first exterior surface of the nonwoven structure is greater, as determined by optical image analysis, than the concentration of activated carbon adjacent the second exterior surface of the nonwoven structure.

Although the inventors should not be held to a particular theory of operation, it is believed that the structure of FIGS. 3 and 4 represents an enhanced two-sided or non-homogeneous distribution of activated carbon within the matrix of pulp fibers as described above. While the distribution of activated carbon within the pulp fiber matrix does not appear to follow a precise gradient pattern, it is believed that a cross-section of the structure would exhibit increasing concentrations of activated carbon approaching its first exterior surface and increasing concentrations of pulp fibers approaching its second exterior surface. Desirably, the concentration gradient of available activated carbon surface area throughout the pulp fiber matrix is relatively non-linear. The pulp rich surface corresponds to the forming wire side of the structure and the activated carbon rich surface corresponds to the opposite surface.

Because the particles of activated carbon desirably have an average size of less than about 350 mesh, a large proportion of activated carbon is present in the sheet. The wet-forming process can be manipulated so that the activated carbon particles/fines in the newly deposited pulp/activated carbon slurry become quite concentrated at the top of the sheet and are "washed-out" at the bottom (i.e., forming wire-side) of the sheet in a relatively non-linear concentration gradient. A greater amount of smaller activated carbon particles (e.g., finer than about 350 mesh) or suitable relatively fibrous activated carbon material is generally believed to result in a relatively non-linear distribution of carbon throughout the sheet with the larger proportion at or adjacent the activated carbon rich surface.

This distribution is believed to be especially advantageous for filtering tobacco smoke drawn along the surface of the adsorbent nonwoven composite material. Concentration of the activated carbon and especially relatively fine activated carbon particles (e.g., finer than about 350 mesh or less and/or suitable relatively fibrous activated carbon material) adjacent or at one surface of a activated carbon is believed to provide greater surface area available for adsorption because of the somewhat non-linear distribution of activated carbon in the matrix and the greater surface area provided by many very fine activated carbon particles. The presence of a large proportion of activated carbon particles at or adjacent a surface of the pulp fiber matrix is believed to be advantageous because some evidence suggests that carbon activity for gas phase components of a tobacco smoke passing over the surface of the pulp fiber matrix is relatively independent of matrix porosity.

Figure 5:
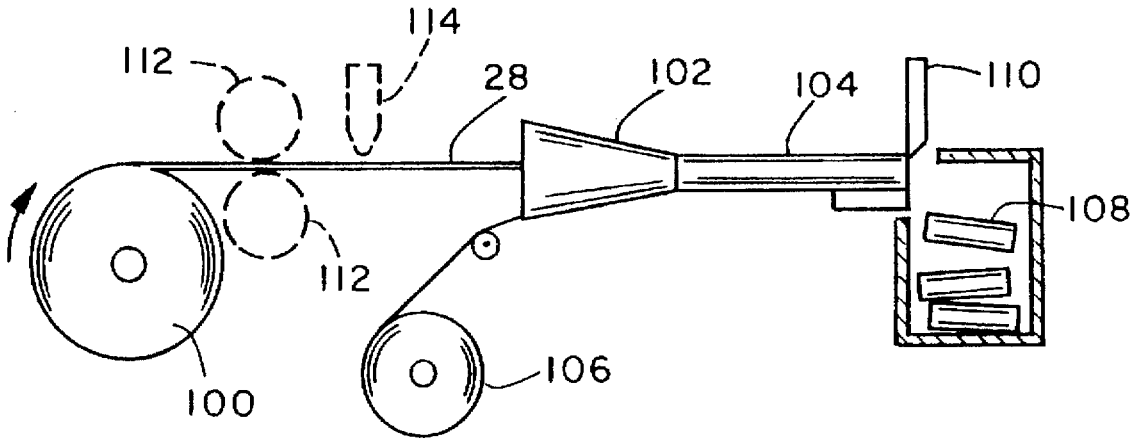
FIG. 5 is a schematic illustration of an exemplary method of forming an adsorbent fibrous nonwoven composite structure into a filter rod.

As shown schematically in FIG. 5, a roll 100 of the adsorbent fibrous nonwoven composite material 28 is unwound and drawn into a pre-forming apparatus 102 that gathers or folds the flat web 28 into a cylindrical shape 104 suitable for passage into the filter rod maker. The formed cylinder 104 is usually carried into a rod-making garniture along with a wrapping paper called plug wrap 106 via an endless forming belt (not shown). Prior to entering the garniture, a continuous bead of adhesive is applied to one edge of the plug wrap via an applicator. As these components pass through the garniture, the formed web is compressed into a cylindrical cross-sectional rod while at the same time being enveloped by plug wrap 106. As the adhesive bead contacts the overlap section of wrapped rod, it is sealed by means of a sealing bar. This endless filter rod is then cut into lengths 108 by means of a blade 110.

Figure 6:
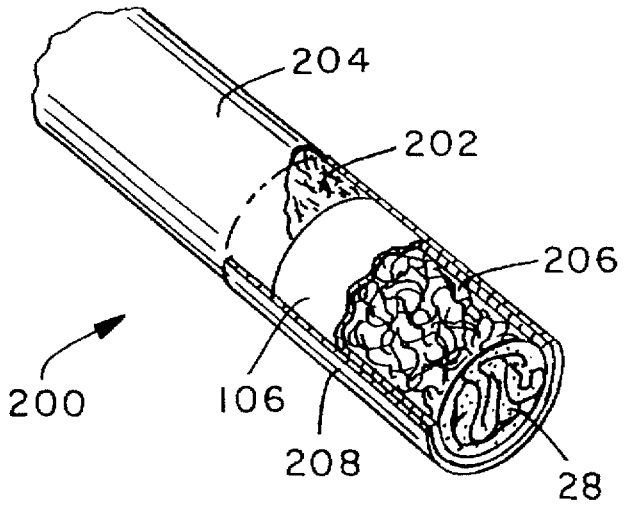
FIG. 6 is a partial perspective view of an exemplary smoking article.

Referring to FIG. 6, a smoking article 200 is partially shown in the form of a cigarette comprising a tobacco rod 202 enclosed by a cigarette wrapper 204 and joined to the filter 206 comprising the adsorbent fibrous nonwoven composite structure 28 and the plug wrap 106 by means of a tipping paper strip 208.

Webs made in accordance with the present invention may be pre-treated prior to being formed into a filter rod 108. Treatments may include, but are not limited to, surface modification treatments, crimping treatments, bonding treatments, thermal treatments and the like. Two exemplary treatments, illustrated in FIG. 5, are a pair of grooved rolls 112 used for crimping and a liquid applicator 114 used for surface treating.

WET-FORMED ABSORBENT FIBROUS NONWOVEN COMPOSITE STRUCTURE

Tensile strength and elongation measurements of samples of the wet-formed absorbent fibrous nonwoven composite structure were made utilizing a Thwing-Albert Model QC-2XS Electron Digital Readout Tensile Strength Tester in accordance with TAPPI-T404 and ASTM-D828. The tester was equipped with Thwing Albert Catalog No. 733B Smooth Faced mechanical grips having a jaw with of about 1 inch (25.4 mm). Measurements of peak load were made in the machine direction for dry samples. Crosshead speed was set to about 51 mm/minute (2 inches/minute). Samples were conditioned at 50 percent relative humidity and 73° F. (23° C.) before testing. Tensile strength refers to the maximum load or force (i.e., peak load) encountered while elongating the sample to break. The results are expressed in units of force (pounds$_f$) for samples that measured 1 inch wide by 6 inches long.

Particles and fibers shed from sample fabrics were measured by a Climet Lint test in accordance with INDA Standard Test 160.0-83 except that the sample size is 6 inch by 6 inch instead of 7 inch by 8 inch.

The basis weights of samples were determined for samples dried in an oven heated to 105° C. until no further weight loss is apparent after continued drying. This condition is generally referred to as "bone-dry" condition. Generally speaking, the basis weights were determined essentially in accordance with ASTM D646, ASTM D202 and TAPPI T411.

Abrasion resistance testing was conducted on a Rotary Platform, Double-Head (RPDH) Abraser: Taber Abraser No. 5130, with Model No. E 140-14 specimen holder, available from Teledyne Taber, North Tonawanda, N.Y. The abrasive wheel was a non-resilient, vitrified, Calibrade grinding wheel No. h-18, medium grade/medium bond, also available from Teledyne Taber. The test was run without counterweights. Samples measured approximately 5 inches×5 inches (12.7 cm×12.7 cm). Testing was conducted generally in accordance with Method 5306, Federal Test Methods Standard No. 191A.

Thickness of the samples was determined utilizing a Model 49-70 thickness tester available from TMI (Testing Machines Incorporated) of Amityville, N.Y. The thickness was measured using a 2-inch diameter circular foot at an applied pressure of about 0.2 pounds per square inch (psi).

Porosity of the adsorbent fibrous nonwoven composite structure was measured in accordance with the CORESTA permeability test procedure utilizing a Bendix-Sheffield variable area porosimeter, Model 60080005, available from Bendix Automation and Measurement Division, Dayton, Ohio.

Adsorption of carbon tetrachloride vapor was determined utilizing samples measuring roughly 100 mm long and 62 mm wide. A hole was punched near the top center of each sample and it was hung in a sheet dryer for five (5) minutes. (A 100° C. circulating oven may be used if a sheet dryer is not available.) Samples were removed from the dryer and then mounted on a balance hook so that they were separated. The samples were weighed after exposure to ambient air for ten (10) minutes.

A small amount of carbon tetrachloride ($CCl_4$) was placed in the bottom of a 1000 ml resin kettle. Sufficient $CCl_4$ was added so that liquid $CCl_4$ is present throughout the test and liquid $CCl_4$ completely covered the bottom of the resin kettle. Generally speaking, about 25–40 milliliters of $CCl_4$ was adequate.

The resin kettle was raised up to enclose the samples and to obtain a crude seal between the rim of the kettle and the underside of the balance support. A lab jack platform was raised to support the kettle. The samples were exposed to $CCl_4$ vapor for ten (10) minutes and then weighed. Adsorption of $CCl_4$ vapor (i.e., $CCl_4$ pickup) was calculated from the difference between the initial sample weight and the final sample weight.

EXAMPLE 1

An adsorbent sheet was formed from a dilute aqueous suspension containing about 17 percent (based on the total weight of the material suspended in water) Calgon Carbon Type PCB Granular Activated Carbon available from Calgon Carbon of Pittsburgh, Pa. and about 83 percent Alberni K softwood pulp available from Kimberly Clark Corporation.

The dilute suspension of fibers and adsorbent materials was formed into a sheet utilizing a conventional Fourdrinier-type papermaking machine. The Fourdrinier-type machine utilized a conventional forming fabric and vacuum dewatering.

After the water was drained from the wet-formed composite material, it was transferred to a conventional steam can drying operation in which the steam cans were heated to about 150°–175° F. (65°–80° C.). Physical properties and test results reported in the following tables for this material are identified as "Sample 1".

EXAMPLE 2

An adsorbent sheet was formed from a dilute aqueous suspension containing about 50 percent (based on the total weight of the suspended material in the slurry) Calgon Carbon Type PCB Granular Activated Carbon available from Calgon Carbon of Pittsburgh, Pa. and about 50 percent Alberni K softwood pulp available from Kimberly Clark Corporation. The sheet was formed from the dilute aqueous suspension utilizing the same procedure as in Example 1. Physical properties and test results reported in the following tables for this material are identified as "Sample 2".

EXAMPLES 3–19

Adsorbent sheets were formed from dilute aqueous suspensions containing a given percentage (based on the total weight of the suspended material in the slurry) of a particular activated and a given percentage of Alberni K softwood pulp available from Kimberly Clark Corporation. The sheet was formed from the dilute aqueous suspension utilizing the same procedure as in Example 1. Samples 3–10 contained Calgon Carbon Type PCB Granular Activated Carbon available from Calgon Carbon of Pittsburgh, Pa. Samples 11–13 contained HMC Carbon available from Calgon Carbon. Samples 14 and 15 contained SGL Carbon available from Calgon Carbon. Samples 16, 17, 18 and 19 contained Calgon Carbon Type PCB Granular Activated. Physical properties and test results reported in Table 4 for these materials are identified as "Sample 4–24". Samples 17–18 were tested for $CCl_4$ vapor adsorption using the procedure described above. Results of that testing is reported in Table 5.

CONTROL SAMPLES

Paper sheets were formed from dilute aqueous suspensions containing Alberni K softwood pulp available from Kimberly Clark Corporation. The sheets were formed from the dilute aqueous suspension utilizing the same procedure as in Example 1. Physical properties and test results reported in Table 6 for these materials are identified as "Control 1" and "Control 2".

TABLE 1

| Sample 1 | | | |
|---|---|---|---|
| 10 μm LINT COUNT NUMBER OF PARTICLES | 0.5 μm LINT COUNT NUMBER OF PARTICLES | DRY TABER 0.5" HOLE CYCLES DARK | DRY TABER 0.5" HOLE CYCLES LIGHT |
| 1697 | 79282 | 40 | 43 |
| 2024 | 95764 | 46 | 36 |
| 1252 | 84055 | 43 | 52 |
| 1617 | 86743 | 64 | 50 |
| 2087 | 97890 | 53 | 80 |
| 1152 | 86762 | 43 | 47 |
| 1720 | 86018 | 36 | 62 |
| 1100 | 82183 | 34 | 55 |
| 1509 | 93231 | 49 | 67 |
| 1327 | 92799 | 53 | 56 |

TABLE 2

| Sample 2 | | | |
|---|---|---|---|
| 10 μm LINT COUNT NUMBER OF PARTICLES | 0.5 μm LINT COUNT NUMBER OF PARTICLES | DRY TABER 0.5" HOLE CYCLES DARK | DRY TABER 0.5" HOLE CYCLES LIGHT |
| 4749 | 115642 | 28 | 29 |
| 5278 | 116856 | 43 | 42 |
| 3351 | 115424 | 38 | 41 |
| 2658 | 115013 | 39 | 32 |
| 3687 | 116505 | 38 | 39 |
| 1900 | 116197 | 30 | 29 |
| 2627 | 122497 | 34 | 33 |
| 3165 | 115967 | 34 | 37 |
| 3413 | 119665 | 43 | 36 |
| 2757 | 118871 | 33 | 38 |

TABLE 3

| SAMPLE | 10 μm LINT | 0.5 μm LINT | DRY TABER 0.5" HOLE DARK | DRY TABER 0.5"HOLE LIGHT |
|---|---|---|---|---|
| 1 Mean | 1549 | 89473 | 46 | 55 |
| SD* | 345 | 6617 | 9 | 13 |
| 2 Mean | 3359 | 117264 | 36 | 36 |
| SD* | 1016 | 2366 | 5 | 5 |

*Standard Deviation

TABLE 4

| Sample | % Carbon | Basis Weight gsm | Tensile g/in | CORESTA cm/min | Thickness mils |
|---|---|---|---|---|---|
| 3 | 53 | 47.5 | 1850 | 65 | |
| 4 | 57 | 49.7 | 2225 | 65 | 5.9 |
| 5 | 50 | 52.8 | 2400 | 44 | 6.0 |
| 6 | 26 | 57.2 | | | |
| 7 | 32 | 52.9 | 3350 | 29 | 5.9 |
| 8 | 30 | 52.5 | 3450 | 40 | 6.0 |
| 9 | 17 | 50.4 | 3475 | 27 | 6.2 |
| 10 | 17 | 50.9 | 3475 | 44 | 6.0 |
| 11 | 48 | 50.6 | 2100 | 89 | 6.3 |
| 12 | 51 | 55.4 | 2200 | 88 | |
| 13 | 54 | 51.0 | | 84 | 6.2 |
| 14 | 52 | 52.5 | 2500 | 36 | 6.5 |
| 15 | 54 | 51.9 | | 76 | |
| 16 | 60 | 49.5 | 2483 | 140 | 5.9 |
| 17 | 57 | 50.1 | 2700 | 78 | 7.2 |
| 18 | 66 | 49.5 | 2483 | 140 | 5.9 |
| 19 | 57 | 50.1 | 2700 | 78 | 7.2 |
| Control1 | | 49.6 | 5050 | 5 | 4.3 |
| Control2 | | 42.9 | 5050 | 4 | 4.4 |

TABLE 5

| Sample | $CCl_4$ Adsorption gsm |
|---|---|
| 17 | 18.2 |
| 18 | 17.8 |

ANALYTICAL IMAGE ANALYSIS

Samples were formed from a dilute aqueous suspension containing about 50 percent (based on the total weight of the suspended material in the slurry) Calgon Carbon Type PCB Granular Activated Carbon available from Calgon Carbon of Pittsburgh, Pa. and about 50 percent Alberni K softwood pulp available from Kimberly Clark Corporation utilizing the same procedure as in Example 1. Concentrations of pulp fibers and activated carbon material adjacent each exterior surface of twenty-two samples were determined by analytical image analysis. In this analytical technique, an image was generated utilizing a Leica Wild M420 macro imaging system at approximately 20× (linear) magnification for each side of a randomly selected portion of each 8 inch by 11 inch (20 cm×28 cm) sample. Oblique illumination was provided from two opposed bifurcated light guides configured at a 45 degree angle from the sample. The light guides were equipped with detachable lenses and were attached to a Fostec 8375 light source. The generated image was processed by a Cambridge Quantimet-10 image analyzer available from Leica, Inc. of Deerfield, Ill.

The threshold was set on the carbon-rich side of the sample and adjusted so that the black particles were clearly detected. The carbon area percent was measured for each side of the paper. An assumption was made that the sum of these two measurements represents 100 percent of the carbon on both sides of each paper. Consequently, the ratio of carbon to total carbon would be a measure of the carbon distribution between the two sides. The raw data is attached as table 1. The higher carbon side of these papers was found to contain 66 percent of the total carbon by this technique. The experimental variability was observed to be 3 percent.

Samples analyzed by image analysis were substantially flat sheets without bumps, crumples, wrinkles, projections or rugosities that could create shadows or shaded areas to distort the optical analysis. The samples contained activated carbon granules which are black and pulp fibers which are white. If other activated carbon and/or fibers having little contrast are used, it is contemplated that dyes or stains could be added to color either the activated carbon or the fiber matrix so sufficient contrast exists between the components to permit meaningful image analysis.

TABLE 6

| Sample | % Carbon Dark | % Carbon Light | % Carbon in Darker Side |
|---|---|---|---|
| A | 0.518 | 0.299 | 63 |
| B | 0.531 | 0.238 | 69 |
| C | 0.512 | 0.264 | 66 |
| D | 0.518 | 0.193 | 73 |
| E | 0.530 | 0.297 | 64 |
| F | 0.506 | 0.266 | 66 |
| G | 0.486 | 0.277 | 64 |
| H | 0.510 | 0.218 | 70 |
| I | 0.470 | 0.286 | 62 |
| J | 0.509 | 0.311 | 62 |
| K | 0.527 | 0.259 | 67 |
| L | 0.494 | 0.318 | 61 |
| M | 0.524 | 0.286 | 65 |
| N | 0.467 | 0.223 | 68 |
| O | 0.512 | 0.268 | 66 |
| P | 0.526 | 0.259 | 67 |
| Q | 0.483 | 0.286 | 63 |
| R | 0.498 | 0.245 | 67 |
| S | 0.497 | 0.244 | 67 |
| T | 0.501 | 0.279 | 64 |
| U | 0.508 | 0.263 | 66 |
| V | 0.498 | 0.235 | 68 |

Average 66% ± 3%

As can be seen from the Tables, the adsorbent nonwoven fibrous structures of the present invention can provide useful loadings of activated carbon materials in a fiber matrix having desirable levels of tensile strength, thickness (i.e., thinness) and porosity. The enhanced two-sidedness or non-homogenous distribution of the adsorbent nonwoven fibrous structures is believed to preserve the structural integrity of the fiber matrix having a high fiber concentration (adjacent a first exterior surface) while permitting high loadings of activated carbon material in the opposite portion of the fiber matrix (adjacent a second exterior surface).

The tensile strength of the adsorbent fibrous nonwoven composite structure was generally less than the tensile strength of the control material. The change in strength varied with the amount and type of activated carbon added to the pulp fibers. Some of the samples had more than 60 percent of the strength of the control at activated carbon loadings exceeding 50 percent.

Generally speaking, the thickness of the adsorbent fibrous nonwoven composite structure was about 25 to about 75 percent more than the thickness of the control material. The porosity of the adsorbent composite structure was substantially greater than the porosity of the control material. The porosity increased from about 500 to about 3500 percent.

The changes in tensile strength, thickness and porosity varied with the amount and type of activated carbon added to the pulp fibers.

FILTER FOR TOBACCO SMOKE

Sample cigarette filters were manufactured from the adsorbent nonwoven fibrous composite materials described above. Comparative examples were prepared from conventional commercially available cellulose acetate tow filters and from commercially available activated carbon/cellulose acetate tow filters.

EXAMPLE A

Example A was a comparative example demonstrating a commercially available activated carbon/cellulose acetate tow filter. The sample cigarette was a Lark® brand cigarette available from the Liggett Group, Inc. of Durham, N.C. The cigarette filter was an activated carbon granule filter measuring about 20 mm in length and contains two cellulose acetate filter segments each measuring about 7 mm in length separated by a 6 mm long chamber filled with granules of activated carbon. The filter was attached to the conventional Lark® cigarette tobacco rod. The cigarette was smoked utilizing a conventional smoking machine and the smoke was analyzed utilizing conventional equipment and techniques by the Analytical Services Division of Labstat Incorporated, Ontario, Canada. Test results for Example A are reported in the following tables as "Sample A". Amounts of carbonyl components are reported in units of micrograms per cigarette. Amounts of tar, nicotine, carbon monoxide and water are reported in units of milligrams per cigarette. The standard deviation for each result is also reported.

EXAMPLE B

Example B was a comparative example demonstrating a commercially available cellulose acetate tow filter. The sample cigarette was an 85 mm (standard) Marlboro® brand cigarette available from Philip Morris, Richmond, Va. The cigarette filter was a conventionally formed filter made of cellulose acetate tow treated with triacetin plasticizer. The tow filaments had a "Y" cross-section, about 2.7 denier per filament and a total denier of about 35,000. The filter had a length of about 20 mm and was attached to the conventional Marlboro® cigarette tobacco rod. The cigarette was tested as described in Example A. Test results for Example B are reported in the following tables as "Sample B".

EXAMPLE C

Example C was made from the adsorbent nonwoven fibrous composite material of Example 6 identified in Table 5 as Sample 6. The composite material contained about 50 percent, by weight, activated carbon having an average particle size of about 350 mesh (Calgon Carbon Type PCB Granular Activated Carbon available from Calgon Carbon of Pittsburgh) Pennsylvania. The composite material had basis weight of about 52.8 gsm and a thickness of about 6 mils. The adsorbent nonwoven fibrous composite material was formed into an activated carbon filter plug utilizing conventional filter making equipment as illustrated in FIG. 5. The filter was wrapped with a non-porous plug wrap having the trade designation SPW-310 available from Kimberly-Clark Corporation. An 11 mm segment of conventional cellulose acetate filter (in a Marlboro® cigarette) immediately adjacent the tobacco rod was removed. The segment was replaced with an 11 mm segment of the activated carbon filter. The filter had an overall length of about 20 mm and was attached to the conventional Marlboro® cigarette tobacco rod. The cigarette was tested as described in Example A. Test results for Example C are reported in the following tables as "Sample C".

EXAMPLE D

Example D was made from the adsorbent nonwoven fibrous composite material of Example 9 identified in Table 5 as Sample 9. The composite material contained about 30 percent, by weight, activated carbon having an average particle size of about 350 mesh (Calgon Carbon Type PCB Granular Activated Carbon available from Calgon Carbon of Pittsburgh) Pennsylvania. The composite material had basis weight of about 52.5 gsm and a thickness of about 6 mils. The adsorbent nonwoven fibrous composite material was formed into an activated carbon filter plug as described above, wrapped with the same non-porous plug wrap and incorporated into a conventional Marlboro® cigarette as described in Example C. The cigarette was tested as described in Example A. Test results for Example D are reported in the following tables as "Sample D".

EXAMPLE E

Example E was a comparative example demonstrating a commercially available activated carbon/cellulose acetate tow filter. The sample cigarette was a Lark® cigarette available from the Liggett Group, Inc. of Durham, N.C. The cigarette filter was an activated carbon granule filter measuring about 20 mm in length and contains two cellulose acetate filter segments each measuring about 7 mm in length separated by a 6 mm long chamber filled with granules of activated carbon. The filter was attached to the conventional Marlboro® cigarette tobacco rod. The cigarette was tested as described in Example A. Test results for Example E are reported in the following tables as "Sample E".

TABLE 7

| | DELIVERY | | | | | | | |
|---|---|---|---|---|---|---|---|---|
| SAMPLE | FORMAL-DEHYDE (UG/CIG) | ACETYL-ALDEHYDE (UG/CIG) | ACETONE (UG/CIG) | ACROLEIN (UG/CIG) | PROPANOL (UG/CIG) | 2-BUTENAL (UG/CIG) | 2-BUTANONE (UG/CIG) | BUTYR-ALDEHYDE (UG/CIG) |
| A | 15(3) | 419(56) | 10(6) | 28(4) | 6.1(0.9) | 20.13(2.4) | 20.1(2.4) | 17.5(1.4) |
| B | 17(3) | 612(41) | 150(10) | 41(5) | 52(4) | 9.3(1.5) | 23.4(1.9) | 25.5(2.3) |
| C (50% Carbon) | 11(1) | 440(30) | 81(6) | 19(4) | 26(2) | 2.6(0.5) | 11.6(0.8) | 11.3(1.4) |
| D (30% Carbon) | 11(2) | 490(37) | 93(13) | 23(3) | 32(3) | 3.2(0.8) | 14.1(2.1) | 14.0(1.8) |
| E | 31(1) | 514(40) | 117(4) | 31(4) | 40(4) | 6.6(0.9) | 20.1(1.3) | 20.2(1.4) |

TABLE 8

| SAMPLE | CARBON MONOXIDE (MG/CIG) | PUFF NUMBER | WATER (MG/CIG) | NICOTINE (MG/CIG) | TAR (MG/CIG) |
|---|---|---|---|---|---|
| | DELIVERY | | | | |
| A | 12(1) | 8.1(0.5) | 2.2(0.5) | 0.92(0.02) | 12.9(1.1) |
| B | 18(2) | 9.8(0.3) | 3.0(0.6) | 1.16(0.06) | 16.8(1.5) |
| C 50% Carbon | 17(1) | 9.7(0.3) | 2.0(0.4) | 0.84(0.04) | 12.2(0.7) |
| D 30% Carbon | 17(2) | 9.7(0.4) | 2.6(0.5) | 0.99(0.05) | 14.1(0.8) |
| E | 16(1) | 8.8(0.5) | 2.4(0.6) | 1.04(0.04) | 15.5(1.0) |

TABLE 9

| SAMPLE | FORMALDEHYDE (UG/CIG) | ACETYLALDEHYDE (UG/CIG) | ACETONE (UG/CIG) | ACROLEIN (UG/CIG) | PROPANOL (UG/CIG) | 2-BUTENAL (UG/CIG) | 2-BUTANONE (UG/CIG) | BUTYRALDEHYDE (UG/CIG) |
|---|---|---|---|---|---|---|---|---|
| | DELIVERIES NORMALIZED TO SAMPLE B | | | | | | | |
| B | 17(3) | 612(41) | 150(10) | 41(5) | 52(4) | 9.3(1.5) | 23.4(1.9) | 25.5(2.3) |
| C 50% Carbon | 15(1) | 607(30) | 112(6) | 26(4) | 36(2) | 3.6(0.5) | 16.0(0.8) | 15.6(1.4) |
| D 30% Carbon | 13(2) | 583(37) | 111(13) | 27(3) | 38(3) | 3.8(0.8) | 16.8(2.1) | 16.7(1.0) |

The results of the smoke analysis are given in Tables 8 and 9. Table 8 lists the carbonyl analysis of the mainstream smoke. Generally speaking, carbonyls are defined as organic compounds found in tobacco smoke in which an oxygen atom is fully bonded to a single carbon atom. Low molecular weight carbonyl compounds (i.e., carbonyl compounds containing 3 to 4 carbon atoms—also called the $C_3$–$C_4$ carbonyl component of tobacco smoke) are typically considered the source of harsh or biting taste in some cigarettes. In general, they are considered undesirable in cigarette smoke.

Carbonyl compounds measured during testing of the cigarette smoke ranged from 1 to 4 carbon atoms—the $C_1$–$C_4$ carbonyl component. The specific carbonyl compounds measured were formaldehyde, acetaldehyde, acetone, 2-propenal (a.k.a. acrolein), propionaldehyde (a.k.a. propanol), 2-butenal (a.k.a. crotonaldehyde), 2-butanone (a.k.a. methyl ethyl ketone) and n-butryaldehyde.

Table 9 gives the total cigarette delivery and puff count. From Table 9, it can be seen that when a section of the conventional cellulose acetate tow filter is replaced by the activated carbon filter of the present invention, the tar deliveries (a particulate material component of tobacco smoke) are decreased. This is because the activated carbon filter is a more efficient filter for particulate matter than conventional cellulose acetate tow. As was expected, the gas phase component, carbon monoxide, was unchanged.

In order to show that the activated carbon filter of the present invention selectively reduces or adsorbs certain carbonyl components of the tobacco smoke-stream, it was considered useful to scale the measured carbonyl values upward to compensate for improved particulate filtration provided by the activated carbon filter. The amount of upward scale is based on the reduced amount of tar delivered by tobacco smoke passing through the activated carbon filter in comparison to the tar delivered via a conventional cellulose acetate tow filter. It is generally thought that tar is representative of particulates in the tobacco smoke-stream.

The measured delivery values of carbonyl compounds were scaled upward by the percentage difference between the measured tar delivery of Sample B and the measured tar delivery of Sample C and Sample D, respectively. The B–C difference was about 38 percent. The B–D difference was about 19 percent. It is important to note that the nicotine and water values correspond well when the tar values of Samples C and D are scaled to Sample B because these materials are generally present in the form of particulates. However, the carbon monoxide values become artificially high because it is a gas phase material and is not impacted by the activated carbon filter.

It can be seen from Table 10 that when the activated carbon filter of the present invention is used with tobacco smoke, delivery of ketones and aldehydes having three or four carbon atoms is reduced by at least 30 percent over the deliveries measured for convention cellulose acetate tow filters and at least as much as a relatively complex activated carbon granule filter. The delivery of ketones and aldehydes having only one or two carbon atoms is appears to be less affected. In general, the lower boiling points of these compounds are believed to result in a greater percentage of these components being in the gas phase and thus less affected as the tobacco smoke passes over the filter. It is contemplated that, in some situations, the filter of the present invention may selectively reduce components of tobacco smoke in addition to the desired selective reduction of the $C_3$–$C_4$ carbonyl component.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A filter for tobacco smoke composed of at least one layer of a wet-formed absorbent fibrous nonwoven composite structure comprising:

about 30 to about 65 percent, by weight, of pulp fibers forming a matrix having a first exterior surface and a second exterior surface;

about 35 to 70 percent, by weight, of activated carbon integrated into the matrix of pulp fibers such that the concentration of activated carbon adjacent the first exterior surface is at least about 60 percent, as determined by optical image analysis, and the concentration of activated carbon adjacent the second exterior surface is less than about 40 percent, as determined by optical image analysis, so that the filter is adapted to selectively reduce the $C_3$–$C_4$ carbonyl component of conventional tobacco smoke at least about 25 percent more than a conventional cellulose acetate filter for a substantially identical tobacco smoke.

2. The filter of claim 1, wherein said wet-formed absorbent fibrous nonwoven composite structure is adapted to selectively reduce the $C_3$–$C_4$ carbonyl component of conventional tobacco smoke in a range of about 30 to about 50 percent more than a conventional cellulose acetate filter for a substantially identical tobacco smoke.

3. The filter of claim 1, wherein the wet-formed absorbent fibrous nonwoven composite structure contains about 45 to about 55 percent, by weight of pulp fibers and about 55 to about 45 percent, by weight of activated carbon.

4. The filter of claim 1, wherein the concentration of activated carbon adjacent the first exterior surface is at least about 65 to about 85 percent, as determined by optical image analysis, and the concentration of activated carbon adjacent the second exterior surface is less than about 35 to about 40 percent, as determined by optical image analysis.

5. The filter of claim 1, wherein the filter further comprises channels having a depth of from about 0.12 inch to about 0.4 inch at a density of from about 10 to about 20 channels per inch of width across a planar dimension of the absorbent fibrous nonwoven composite structure.

6. The filter of claim 5, wherein the channels have a depth of from about 0.15 inch to about 0.25 inch and a density of from about 12 to about 16 channels per inch across a planar dimension of the filter.

7. The filter of claim 6, wherein the channels have a depth of from about 0.18 inch to about 0.22 inch and a density of from about 13 to about 15 channels per inch across a planar dimension of the filter.

8. The filter of claim 1, wherein the pulp fibers are selected from hardwood pulp fibers, softwood pulp fibers, and tobacco fibers.

9. The filter of claim 1, wherein the adsorbent fibrous nonwoven composite structure has a basis weight from about 20 gsm to about 100 gsm.

10. The filter of claim 9, wherein the adsorbent fibrous nonwoven composite structure has a basis weight from about 50 gsm to about 55 gsm.

11. The filter of claim 1, wherein the activated carbon has an average particle size less than about 350 mesh.

12. The filter of claim 1, wherein the filter comprises at least two layers of the adsorbent fibrous nonwoven composite structure.

13. A filter for tobacco smoke composed of at least one layer of a wet-formed absorbent fibrous nonwoven composite structure comprising:

about 40 to about 55 percent, by weight, of pulp fibers forming a matrix having a first exterior surface and a second exterior surface;

about 45 to about 60 percent, by weight, of activated carbon integrated into the matrix of pulp fibers such that the concentration of activated carbon adjacent the first exterior surface is at least about 60 percent, as determined by optical image analysis, and the concentration of activated carbon adjacent the second exterior surface is less than about 40 percent, as determined by optical image analysis; and channels having a depth of from about 0.12 inch to about 0.4 inch at a density of from about 10 to about 20 channels per inch of width across a planar dimension of the filter, so that the filter is adapted to selectively reduce the $C_3$–$C_4$ carbonyl component of conventional tobacco smoke at least about 25 percent more than a conventional cellulose acetate filter for an identical tobacco smoke.

14. The filter of claim 13, wherein said wet-formed absorbent fibrous nonwoven composite structure is adapted to selectively reduce the $C_3$–$C_4$ carbonyl component of conventional tobacco smoke in a range of about 30 to about 50 percent more than a conventional cellulose acetate filter for an identical tobacco smoke.

15. The filter of claim 13, wherein the activated carbon is integrated into the matrix of pulp fibers such that the concentration of activated carbon adjacent the first exterior surface is at least about 60 percent, as determined by optical image analysis, and the concentration of activated carbon is less than about 40 percent, as determined by optical image analysis.

16. The filter of claim 13, wherein the channels have a depth of from about 0.15 inch to about 0.25 inch and a density of from about 12 to about 16 channels per inch across a planar dimension of the filter.

17. The filter of claim 13, wherein the activated carbon has an average particle size less than about 350 mesh.

18. A method of making a filter for tobacco smoke composed of at least one layer of a wet-formed absorbent fibrous nonwoven composite structure, the process comprising:

providing an aqueous suspension containing from about 30 percent to about 65 percent pulp fibers and from about 35 percent to about 70 percent activated carbon based on the dry weight of the suspended material, the activated carbon having an average particle size of about 350 mesh or less;

depositing the aqueous suspension onto a paper-making forming surface to form a matrix of pulp fibers having a first exterior surface and a second exterior surface with adsorbent material integrated into the matrix of pulp fibers;

removing water from the matrix of pulp fibers under sufficient vacuum so that activated carbon is concentrated near one surface of the matrix to yield an adsorbent fibrous nonwoven composite structure;

substantially drying the adsorbent fibrous nonwoven composite structure; and gathering the adsorbent fibrous nonwoven composite structure into the shape of a radially elastic filter body;

wherein the filter is adapted to selectively reduce the $C_3$–$C_4$ carbonyl component of conventional tobacco smoke at least about 25 percent more than a conventional cellulose acetate filter for an identical tobacco smoke.

19. The method of claim 18 further comprising the step of creating channels in the adsorbent fibrous composite structure prior gathering the adsorbent fibrous nonwoven composite structure into the shape of a radially elastic filter body; the channels having a depth of from about 0.12 inch to about 0.4 inch at a density of from about 10 to about 20 channels per inch of width across a planar dimension of the adsorbent fibrous nonwoven composite structure.

20. The method of claim 18 wherein the vacuum is sufficient to provide an adsorbent fibrous nonwoven composite structure having a concentration of adsorbent material adjacent the first exterior surface of the matrix of at least about 60 percent, as determined by optical image analysis, and a concentration of adsorbent material adjacent the second exterior surface of the matrix of less than about 40 percent, as determined by optical image analysis.

21. The method of claim 18 wherein the aqueous suspension containing pulp fibers and activated carbon is free of wet-end suspension additives.

* * * * *